US009969175B2

(12) United States Patent
Naito et al.

(10) Patent No.: US 9,969,175 B2
(45) Date of Patent: May 15, 2018

(54) LIQUID CONTAINER

(71) Applicant: SEIKO EPSON CORPORATION, Tokyo (JP)

(72) Inventors: Naoki Naito, Nagano (JP); Yuji Aoki, Hara-mura (JP); Hiroshi Nose, Nagano (JP); Munehide Kanaya, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days. days.

(21) Appl. No.: 15/080,684

(22) Filed: Mar. 25, 2016

(65) Prior Publication Data

US 2016/0288516 A1 Oct. 6, 2016

(30) Foreign Application Priority Data

Mar. 30, 2015 (JP) ..... 2015-070367
Jun. 26, 2015 (JP) ..... 2015-128472

(51) Int. Cl.
*B41J 2/175* (2006.01)

(52) U.S. Cl.
CPC ..... *B41J 2/17553* (2013.01); *B41J 2/17506* (2013.01)

(58) Field of Classification Search
CPC ..... B41J 2/17553
See application file for complete search history.

(56) References Cited

U.S. PATENT DOCUMENTS 6,161,927 A * 12/2000 Long ..... B41J 2/17503 347/86
2013/0169720 A1* 7/2013 Nakamura ..... B41J 2/175 347/86
2014/0063147 A1* 3/2014 Iwamuro ..... B41J 2/17543 347/86
2017/0066248 A1 3/2017 Ono

FOREIGN PATENT DOCUMENTS

JP 2014-046588 A 3/2014
JP 2014-046624 A 3/2014

OTHER PUBLICATIONS

The Extended European Search Report for the corresponding European Application No. 16162847.4 dated Sep. 27, 2016.

* cited by examiner

*Primary Examiner* — Alessandro Amari
*Assistant Examiner* — Roger W Pisha, II

(57) ABSTRACT

Provided is a liquid container that is able to prevent or suppress spilling of a liquid that is poured into an opening part. An ink cartridge has a first wall part defining a rear end of the ink cartridge and a second wall part extending on a forward side +X from an upper edge of the first wall part. An ink inlet port that receives ink for refilling is formed in the second wall part. Ink is poured into the ink inlet port from the first wall part side. The ink inlet port has a length dimension in the front-rear direction X that is longer than in the width direction Y, and thus readily receives ink that is poured therein.

24 Claims, 7 Drawing Sheets

LIQUID CONTAINER

Priority is claimed under 35 U.S.C. § 119 to Japanese Applications No. 2015-128472 filed on Jun. 26, 2015 and No. 2015-070367 filed on Mar. 30, 2015 which are hereby incorporated by reference in their entirety.

BACKGROUND

1. Technical Field

The present invention relates to a liquid container into which a liquid can be filled through an opening part.

2. Related Art

An ink cartridge that is mounted in a cartridge mounting part of an inkjet printer and supplies ink to a print head is known. The cartridge mounting part is provided with an ink introduction needle in communication with the print head, and the ink cartridge has an ink supply port in a front surface thereof in the direction in which the ink cartridge is mounted in the cartridge mounting part. The ink introduction needle is inserted into the ink supply port when the ink cartridge is mounted in the cartridge mounting part, enabling supply of ink from the ink cartridge to the print head.

An ink cartridge described in JP-A-2014-46624 is provided with an ink inlet port (opening part) for refilling ink in a posterior portion thereof in the mounting direction. The ink inlet port is a round hole, and is formed in a second wall extending on the forward side from an upper edge of a first wall defining the rear end of the ink cartridge. The ink inlet port is normally sealed by a plug member, and is opened when ink is refilled.

Here, the ink for refilling is contained in an ink pack made from a flexible film formed to have a bag shape. When refilling ink, the user positions the ink pack on the rearward side of the first wall and pours the ink toward the ink inlet port that is on the forward side thereof.

However, when the user pours the ink, ink may spill from the ink inlet port.

SUMMARY

An advantage of some aspects of the invention is to provide a liquid container that is able to prevent or suppress spilling of a liquid that is poured into an opening part.

According to an aspect of the invention, a liquid container includes a first wall and a second wall extending in a first direction that intersects the first wall. The second wall has an opening part configured to receive a liquid that is poured therein from a side of the first wall, and the opening part has a length dimension in the first direction that is longer than a width dimension in a second direction that intersects the first direction.

According to this aspect of the invention, the opening part configured to receive the liquid that is poured therein from the first wall side is long in the first direction. Accordingly, when the liquid is poured in the first direction, the liquid is readily received by the opening part.

According to an aspect of the invention, it may be desirable that a peripheral wall part at least partially surrounding the opening part is provided on the second wall, and that the peripheral wall part has a groove located closer to a rear end of the opening part in the first direction than to a front end of the opening part in the first direction. By adopting this configuration, even if liquid spills from the opening part, the flow of the liquid can be dammed by the peripheral wall part. Also, by engaging the vessel in which the liquid for refilling is contained in the groove when pouring the liquid, the vessel can be prevented from moving. Accordingly, spilling of the liquid from the opening part can be prevented or suppressed.

According to an aspect of the invention, a configuration can be adopted in which a groove located closer to a rear end of the opening part in the first direction than to a front end of the opening part in the first direction is formed in a surface of the second wall. By adopting this configuration, the vessel in which the liquid for refilling is contained can be engaged in the groove when pouring the liquid to prevent the vessel from moving. Accordingly, spilling of the liquid from the opening part can be prevented or suppressed.

According to an aspect of the invention, it may be desirable that the second direction is orthogonal to the first direction, and that a front end of the opening part in the first direction is formed to have a linear shape extending in the second direction. By adopting this configuration, even in the case where the direction in which the liquid is poured from the vessel inclines relative to the first direction, the length dimension of the opening part in the direction of inclination can be prevented from being shorter than the length dimension of the opening part in the direction before inclination (first direction). Therefore, even in the case where the direction in which the liquid is poured from the vessel inclines relative to the first direction, the liquid is readily received by the opening part.

According to an aspect of the invention, it may be desirable that a protruding part extending in the second direction is provided on the second wall at a position adjoining the opening part on a forward side in the first direction. By adopting this configuration, in cases such as where the liquid is poured vigorously from the vessel in the first direction and liquid goes further on the forward side than the opening part, the liquid hits the protruding part and flows back to the rearward side and into the opening part. Accordingly, the liquid can be received by the opening part.

According to an aspect of the invention, it may be desirable that the second wall includes, on a periphery of the opening part, a liquid receiving part configured to receive liquid that spills from the opening part. By adopting this configuration, in the case where liquid poured from the vessel misses the opening part, the liquid can be suppressed from running outside the liquid container.

According to an aspect of the invention, it may be desirable that a plug member that removably blocks the opening part is provided. Also, it may be desirable that the plug member includes a plug member main body capable of blocking the opening part and a connecting member for connecting the plug member main body to the second wall, that the connecting member includes a plug member main body side connecting part connected to a posterior portion of the plug member main body in the first direction, an extended part extending in the first direction along a lateral side of the plug member main body in the second direction, and a wall side connecting part configured to be connected to the second wall, and that the wall side connecting part is located on a forward side of the extended part in the first direction. By adopting this configuration, in the case of moving the plug member on the forward side in the first direction to open the opening part, the line of movement of the plug member main body can be prevented from coinciding with the connecting member. Liquid adhering to the plug member main body can thereby be prevented from adhering to the connecting member. Therefore, liquid can be prevented from adhering to the user's hand or the like via the connecting member.

According to an aspect of the invention, it may be desirable that an engaging part for connecting the plug member is provided on the second wall, and that the wall side connecting part is configured to be detachably connected to the engaging part. By adopting this configuration, the connecting member separates from the engaging part when a large force greater than or equal to a given force is applied to the connecting member, when the plug member is pulled in a direction away from the opening part in order to open the opening part. Accordingly, the connecting member can be prevented from being severed when the opening part is opened.

According to an aspect of the invention, a configuration can be adopted in which the liquid is ink. That is, the liquid container can be an ink cartridge that is refillable with ink.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an ink cartridge will be described as an embodiment of a liquid container of the invention, with reference to the drawings.

Ink Cartridge

Figure 1A:
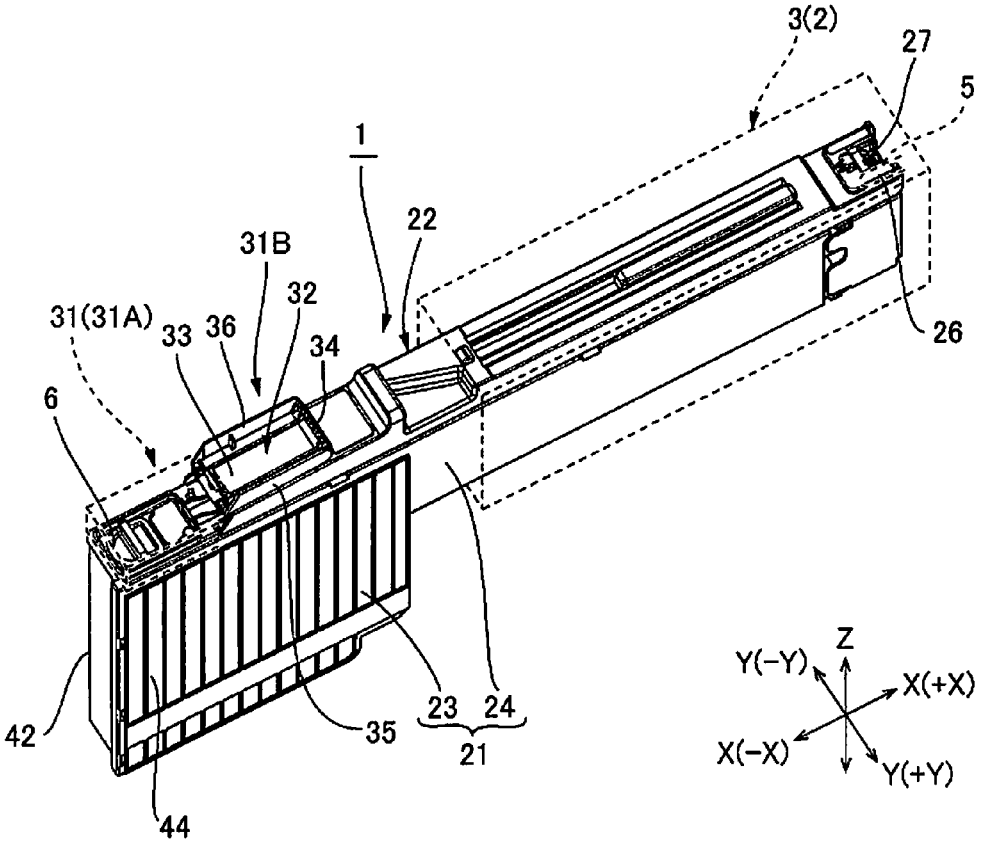
FIGS. 1A and 1B are respectively a perspective view of an ink cartridge and a side view of an ink pack.
Figure 1B:
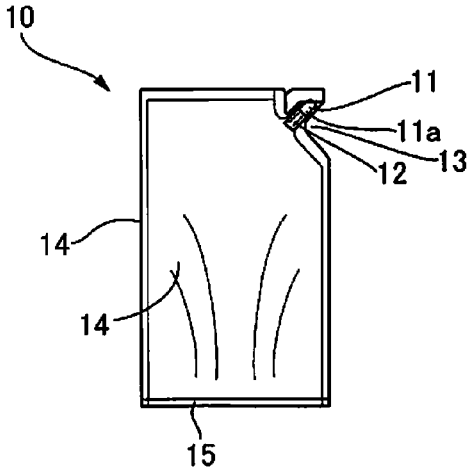

FIG. 1A is a perspective view of an ink cartridge to which the invention is applied, and FIG. 1B is a side view of an ink pack that contains ink for refilling. An ink cartridge 1 of this example is removably mounted in a cartridge mounting part 3 of an inkjet printer 2, and supplies ink that is contained therein to a print head. The orientation of the ink cartridge 1 shown in FIG. 1A is the orientation in which the ink cartridge 1 is mounted in the cartridge mounting part 3.

The ink cartridge 1 has an ink supply port 5 in a front surface thereof in the direction in which the ink cartridge 1 is mounted in the cartridge mounting part 3. The cartridge mounting part 3 has an ink introduction needle (not shown) in communication with the print head, and the ink introduction needle is inserted into the ink supply port 5 when the ink cartridge 1 is mounted in the cartridge mounting part 3. Supply of ink from the ink cartridge 1 to the print head is thereby enabled. Also, the ink cartridge 1 is provided with an ink inlet port (opening part) 6 for filling ink into the ink cartridge 1 at a rear end portion thereof in the mounting direction. The ink cartridge 1 can be refilled with ink via the ink inlet port 6.

Here, as shown in FIG. 1B, the ink for refilling is provided in a state of being filled into an ink pack 10 constituted by a flexible film formed into a bag shape. The ink pack 10 is a self-standing pouch, for example. Also, the ink pack 10 has a rectangular shape that is long in the up-down direction as a whole when viewed from the side, and is provided, in one of the upper corners thereof, with an ink spout 11 extending upwardly outward at an angle.

More specifically, the ink pack 10 is provided with a pair of first films 14 constituting the side surfaces and a second film 15 constituting the bottom (gusset). The two first films 14 are disposed facing each other, and the second film 15 is arranged between the pair of first films 14. The peripheral edge of the second film 15 is heat-welded to the lower edge of each first film 14. The two first films 14 are heat-welded to each other along peripheral edge portions excluding the lower edges thereof. The ink spout 11 is provided by welding together one corner of the pair of first films 14 to form a cylindrical portion 11*a* extending upwardly outward at an angle. The ink spout 11 is provided with a cylinder member 12 heat-welded on the inner side of the cylindrical portion 11*a*. A triangular notch 13 is provided on the lower side of the cylindrical portion 11*a* in the ink pack 10. In the case of pouring ink from the ink pack 10, the tip (heat-welded peripheral edge portion of the pair of first films 14) of the ink spout 11 is cut off, enabling ink to be discharged from the ink pack 10.

Details of Ink Cartridge

Figure 2A:
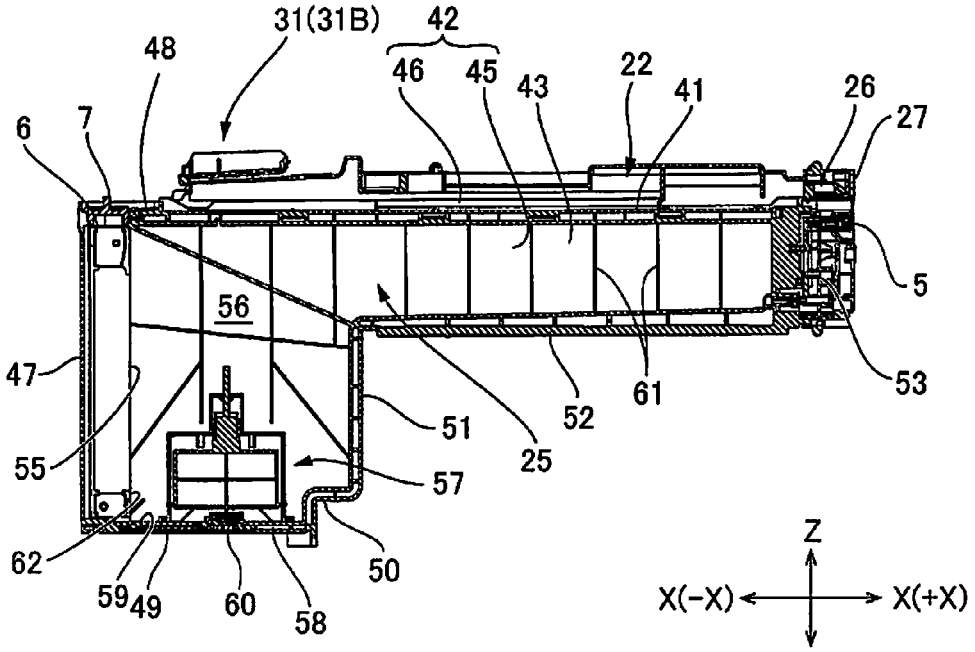
FIGS. 2A and 2B are respectively a cross-sectional view of the ink cartridge and a partial cross-sectional view of the periphery of an ink inlet port.
Figure 2B:
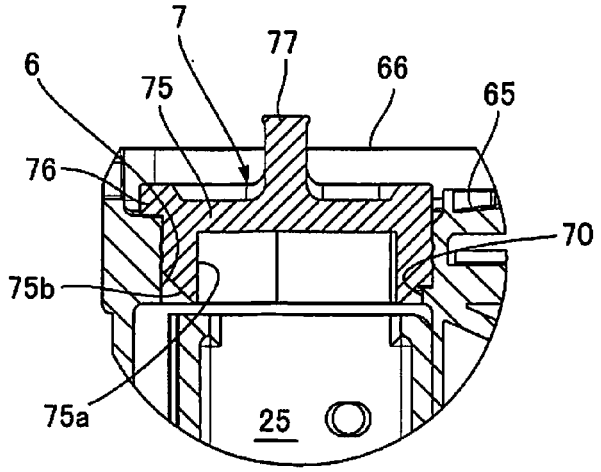

FIG. 2A is a side view of a state where a lid body has been removed from the ink cartridge 1, and FIG. 2B is a partial cross-sectional view of the periphery of the ink inlet port 6. In the following description, the long direction and short direction of the ink cartridge 1 when in the mounting orientation are respectively given as a front-rear direction (first direction) X and a width direction (second direction) Y, and the vertical direction that is orthogonal to the front-rear direction X and the width direction is given as an up-down direction Z. Also, in the ink cartridge 1, the side on which the ink supply port 5 is provided is given as a forward side (anterior) +X, and the opposite side thereto is given as a rearward side (posterior) −X in the front-rear direction. Furthermore, the right side when the ink cartridge 1 is viewed toward the forward side +X from the rearward side −X is one side +Y and the left side is the other side −Y. The forward side +X in the front-rear direction X is the forward side in the mounting direction.

As shown in FIG. 1A, the ink cartridge 1 is provided with a cartridge main body (liquid container) 21 and a slider 22 supported above the cartridge main body 21. The slider 22 is movable in the front-rear direction X along the upper surface of the cartridge main body 21.

The cartridge main body 21 extends in the front-rear direction X at a given width. The cartridge main body 21 is provided with a posterior containing part 23 whose shape when viewed in the width direction Y is substantially square, and an anterior containing part 24 extending on the forward side +X from an upper end portion of the posterior containing part 23. The anterior containing part 24 is a rectangle whose shape when viewed in the width direction Y is long in the front-rear direction X. As shown in FIG. 2, the posterior containing part 23 and the anterior containing part 24 are in communication internally, and the inside of these parts is an ink chamber 25.

The anterior containing part 24 is provided with the ink supply port 5 in a front end surface thereof. The posterior containing part 23 is provided with the ink inlet port 6 in a rear end portion of the upper surface thereof. The ink inlet port 6 is sealed by the plug member 7.

A recording chip 27 is installed in a front end portion of the slider 22 via a chip holder 26. Information relating to the ink contained in the ink cartridge 1 is recorded and held on the recording chip 27. The recording chip 27 is electrically connected to a recording chip reading part (not shown) of the inkjet printer 2 when the slider 22 is moved to the forward side +X after the ink cartridge 1 is mounted in the cartridge mounting part 3. The inkjet printer 2 is thereby able to read information relating to the ink in the ink cartridge 1.

A rear end portion of the slider 22 serves as an opening/closing cover 31. The opening/closing cover 31 is rotatable 180 degrees about an axis extending in the width direction Y. As shown in FIG. 1A, the opening/closing cover 31 moves between a first position 31A in which the opening/closing cover 31 extends on the rearward side −X in a prostrate orientation of being prostrated and a second position 31B in which the opening/closing cover 31 extends on the forward side +X in an inverted orientation of being inverted upside down.

The opening/closing cover 31 constitutes a placing part 32 for placing the plug member 7 that has been removed from the ink inlet port 6 in the inverted orientation in which the opening/closing cover 31 is disposed in the second position 31B. That is, the opening/closing cover 31 is provided with a rectangular flat plate 33, and a first side plate 34, a second side plate 35 and a third side plate 36 that, in the inverted orientation, respectively project upwardly at a given height from the front edge of the flat plate 33, the edge of the flat plate 33 on the one side +Y, and the edge of the flat plate 33 on the other side −Y. The second side plate 35 extends on the rearward side −X continuously from the edge of the first side plate 34 on the one side +Y. The third side plate 36 extends on the rearward side −X continuously from the edge of the first side plate 34 on the other side −Y. In the inverted orientation, the upper surface of the flat plate 33 is a placing surface for placing the plug member 7, and inclines slightly downwardly toward the side (rearward side −X) on which the ink inlet port 6 is located. The first side plate 34, the second side plate 35 and the third side plate 36 surround the placing surface from the forward side +X and both sides in the width direction Y. The placing part 32 that is constituted by the opening/closing cover 31 is located further on the forward side +X than the ink inlet port 6.

As shown by the dotted line in FIG. 1A, in a state where the opening/closing cover 31 is disposed in the first position 31A, the opening/closing cover 31 covers the ink inlet port 6 and the plug member 7 from above and from the rearward side −X and both sides in the width direction Y. That is, the flat plate 33 covers the ink inlet port 6 and the plug member 7 from above, the first side plate 34 covers the ink inlet port 6 and the plug member 7 from the rearward side −X, the second side plate 35 covers the ink inlet port 6 and the plug member 7 from the one side +Y, and the third side plate 35 covers the ink inlet port 6 and the plug member 7 from the other side −Y.

Next, the cartridge main body 21 is provided with a box-like case main body 42 whose opening part 41 faces the one side +Y, a film 43 that is welded to the opening part 41 of the case main body 42 and divides the ink chamber 25 as well as the case main body 42, and a lid body 44 that covers the film 43 and is covered from the one side +Y by the case main body 42. The case main body 42 and the lid body 44 are resin molded articles.

As shown in FIG. 2A, the case main body 42 is provided with a bottom part 45 defining the end in the width direction Y, and a frame part 46 projecting on the one side +Y from a peripheral edge portion of the bottom part 45. The frame part 46 is provided with a first wall part (first wall) 47 extending in the up-down direction, a second wall part (second wall) 48 extending on the forward side +X from an upper edge of the first wall part 47 orthogonally to the first wall part 47, and a third wall part 49 extending on the forward side +X from the lower edge of the first wall part 47 orthogonally to the first wall part 47. Also, the frame part 46 is provided with a fourth wall part 50 extending upwardly from the front edge of the third wall part 49 and then bending and extending on the forward side +X, a fifth wall part 51 extending upwardly from the front edge of the fourth wall part 50 orthogonally to the fourth wall part 50, a sixth wall part 52 extending on the forward side +X from an upper edge of the fifth wall part 51 orthogonally to the fifth wall part 51, and an ink supply port component 53 connecting the front end portions of the second wall part 48 and the sixth wall part 52. The ink supply port component 53 is provided with the ink supply port 5.

The space enclosed by the bottom part 45 and the frame part 46 is the ink chamber 25. A partition wall 55 extending downwardly from the second wall part 48 and partially partitioning the ink chamber 25 is provided within the ink chamber 25. The partition wall 55 extends downwardly from a front edge portion of the ink inlet port 6 in the second wall part 48. A float valve 57 is disposed in an anterior ink chamber 56 on the forward side +X of the partition wall 55 in the ink chamber 25. Also, an ink outlet channel 58 is provided in a bottom portion of the anterior ink chamber 56. The ink outlet channel 58 is provided with an ink outlet port 59 serving as an upstream end opening between the partition wall 55 and the float valve 57 in a bottom portion of the anterior ink chamber 56. Also, the ink outlet channel 58 extends on the forward side +X along the third wall part 49, the fourth wall part 50, the fifth wall part 51 and the sixth wall part 52, and is in communication with the ink supply port 5. Here, the float valve 57 tracks the change in the amount of ink contained in the ink chamber 25 and is displaced. When the residual ink amount in the ink chamber 25 falls to less than or equal to a predetermined amount, the float valve 57 closes a valve port 60 provided partway along the ink outlet channel 58, and stops the flow of ink in the ink outlet channel 58.

Also, a plurality of ribs 61 are provided in the anterior ink chamber 56. Here, the film 43 is heat-welded to the end surface of the partition wall 55 on the one side +Y, the end surface of the ribs 61 on the one side +Y, and the edge of the opening part 41 in the case main body 42 (end surface of the frame part 46 on the one side +Y). Ink poured through the ink inlet port 6 flows via an opening part 62 provided in the partition wall 55 and a notch (not shown) provided in the ribs 61, and is filled into the ink chamber 25.

Ink Injection Port and Periphery Thereof

Figure 3A:
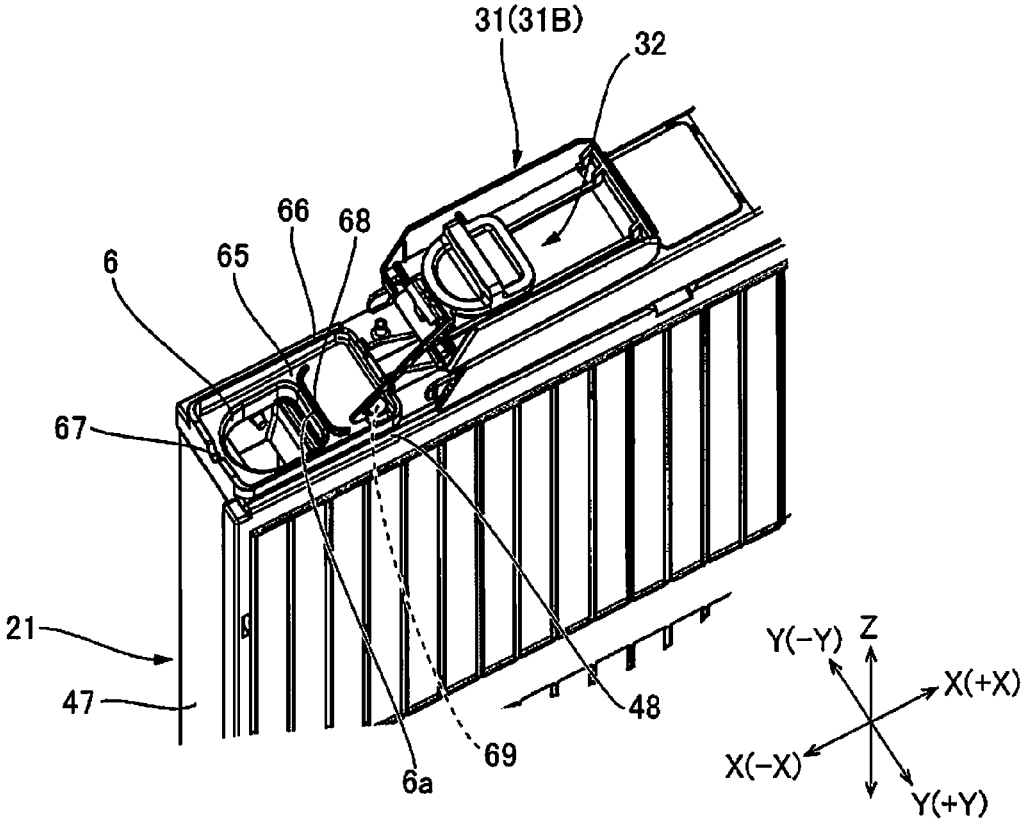
FIGS. 3A and 3B are respectively a perspective view and a plan view of the periphery of the ink inlet port.
Figure 3B:
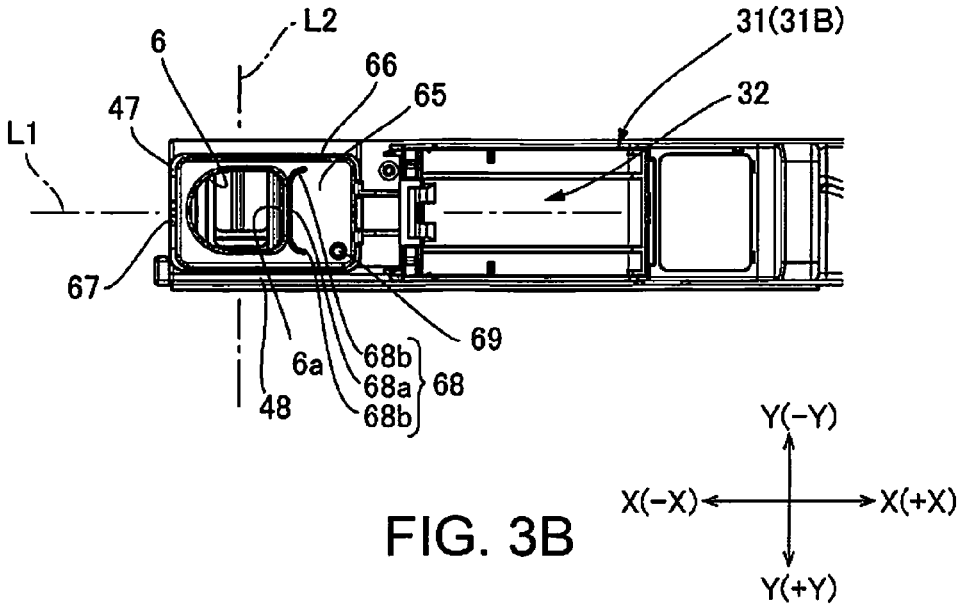

Next, the structure of the ink inlet port 6 and the periphery thereof will be described. FIG. 3A is a perspective view of the ink inlet port 6 and the periphery thereof when viewed from above the rearward side −X, and FIG. 3B is a plan view of the ink inlet port 6 and the periphery thereof when viewed from above. The ink inlet port 6 is formed in a rear end portion of the second wall part 48 of the cartridge main body 21.

As shown in FIG. 3B, the ink inlet port 6 has a length dimension in the front-rear direction X that is longer than a width dimension in the width direction Y. Also, the ink inlet port 6 is symmetrical right and left to an imaginary first center line L1 extending in the front-rear direction X through the center of the second wall part 48 in the width direction Y. Furthermore, the ink inlet port 6 is asymmetrical front and rear to an imaginary second center line L2 extending in the width direction Y through the center of the ink inlet port 6 in the front-rear direction X, and a posterior opening portion on the rear side of the second center line L2 is provided with a shape that spreads out on both sides in the width direction Y toward the forward side +X from the rear end. Also, the ink inlet port 6 has an anterior opening portion on the front side of the second center line L2 whose opening area is larger than the opening area of the posterior opening portion. Furthermore, a front end 6*a* of the ink inlet port 6 has a linear shape extending in the width direction Y. In this example, the shape of the ink inlet port 6 when viewed in the up-down direction Z is bell-shaped.

The second wall part 48 is provided with a liquid receiving surface (liquid receiving part) 65 on the periphery of the ink inlet port 6. The liquid receiving surface 65 is a rectangular region enclosing the ink inlet port 6. The liquid receiving surface 65 inclines downwardly toward the ink inlet port 6 from the peripheral edge thereof.

Also, a peripheral wall part 66 surrounding the ink inlet port 6 is formed on the second wall part 48. The peripheral wall part 66 is provided in a rectangular frame shape along an outer peripheral edge of the liquid receiving surface 65. As shown in FIGS. 3A and 3B, a groove 67 is provided in a peripheral wall portion of the peripheral wall part 66 extending in the width direction Y at the rear end thereof. The groove 67 is formed by cutting away a middle portion of the peripheral wall part 66 in the width direction Y from above in a V-shape.

Here, a protruding part 68 and an engaging part 69 are provided on the liquid receiving surface 65 (region inside the peripheral wall part 66). The protruding part 68 extends in the width direction Y at a position adjoining the ink inlet port 6 on the forward side +X. More specifically, the protruding part 68 is provided so as to extend longer in the width direction Y than the front end 6*a* of the ink inlet port 6. The protruding part 68 is provided with a middle portion 68*a* extending along the front end 6*a* of the ink inlet port 6 in the middle thereof in the width direction Y, and a pair of outer portions 68*b* inclining outwardly toward the forward side +X from the middle portion 68*a*, on both sides of the middle portion 68*a* in the width direction Y.

The engaging part 69 is provided on the forward side +X of the protruding part 68. More specifically, the engaging part 69 is an end portion on the one side +Y at the front end side of the liquid receiving surface 65, and is formed in a position overlapping the end of the ink inlet port 6 on the one side +Y when viewed in the front-rear direction X. The engaging part 69 has a columnar shape and projects upwardly from the liquid receiving surface 65. As shown in FIG. 2B, a projection 70 projecting inwardly is provided at a position adjacent to the ink chamber 25 on an inner peripheral wall portion of the ink inlet port 6. Note that the generation of burrs on the inner peripheral surface of the ink inlet port 6 at the time of resin molding the case main body 21 can be suppressed by providing the projection 70 at such a position.

Plug Member

Figure 4A:
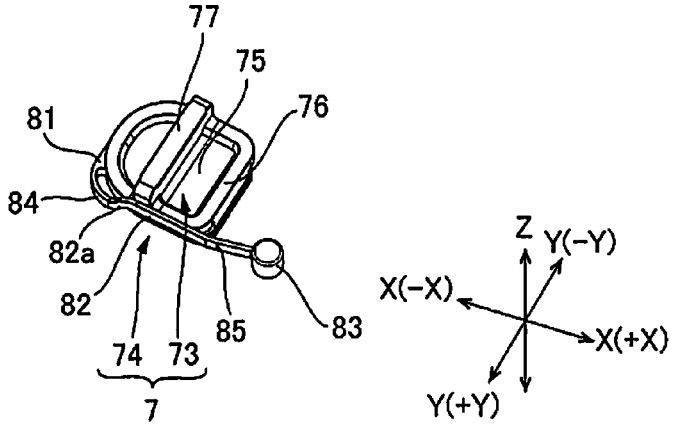
FIGS. 4A to 4C are respectively a perspective view, a side view and a bottom view of a plug member.
Figure 4B:
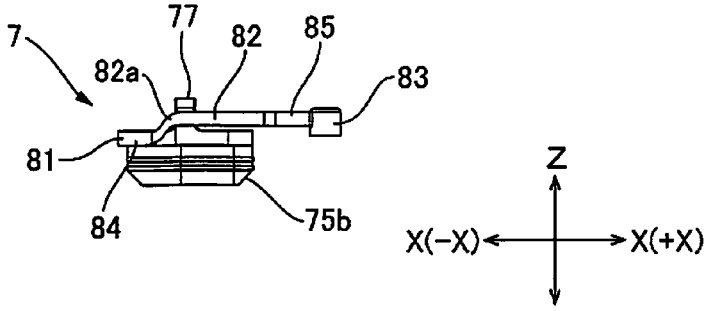
Figure 4C:
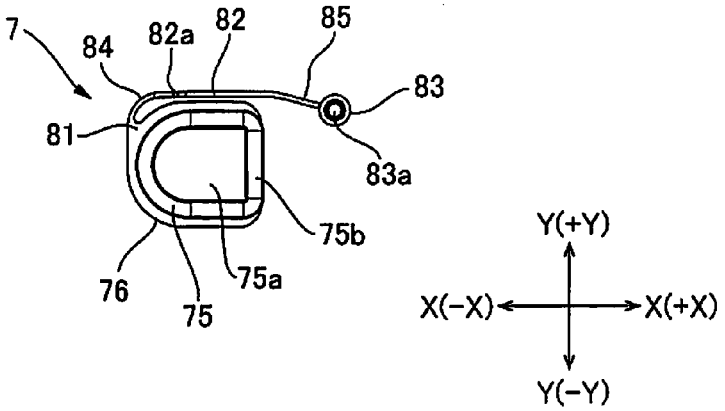

FIG. 4A is a perspective view of the plug member 7 when viewed from above the forward side +X, FIG. 4B is a side view of the plug member 7, and FIG. 4C is a bottom view of the plug member 7 when viewed from below. The plug member 7 is formed from an elastic material such as rubber or an elastomer. As shown in FIG. 4A, the plug member 7 is provided with a plug member main body 73 that blocks the ink inlet port 6, and a connecting member 74 for connecting the plug member main body 73 to the second wall part 48. The plug member main body 73 is provided with a main body part 75 that is provided with a shape corresponding to the ink inlet port 6 when viewed in the up-down direction Z, a flange part 76 projecting on the rearward side −X and on both sides in the width direction Y from an upper end portion of the main body part 75, and a knob part 77 for picking up the plug member main body 73.

As shown in FIG. 4C, the main body part 75 is provided, in a middle portion of a lower surface thereof, with a recessed part 75*a* that has a similar shape to the ink inlet port 6 in plan view. Also, as shown in FIG. 4B, the main body part 75 is provided, on the outer peripheral edge at the lower end thereof, with an inclining surface 75*b* inclining upwardly toward the outer perimeter side. As shown in FIG. 2B, the main body part 75 is inserted into the ink inlet port 6 until the flange part 76 abuts from above against the opening edge of the ink inlet port 6 in the second wall part 48. The knob part 77 projects upwardly from the main body part 75 and the flange part 76. The knob part 77 extends in the width direction Y at a given width.

The connecting member 74 is, as shown in FIG. 4A, provided with a plug member main body side connecting part 81 connected to a posterior portion of the plug member main body 73, an extended part 82 extending in the front-rear direction X along the one side +Y of the plug member main body 73, and a wall part side connecting part 83 that is connected to the second wall part 48. The extended part 82 is provided with a bent part 82*a* extending upwardly at an anterior portion thereof and then bending and extending on the forward side +X. Also, the connecting member 74 is provided with a posterior connecting part 84 connecting the plug member main body side connecting part 81 and the extended part 82, and an anterior connecting part 85 connecting the extended part 82 and the wall part side connecting part 83. The posterior connecting part 84 extends on the one side +Y from the rear end of the plug member main body side connecting part 81 and then curves and extends on the forward side +X, and is continuous with the extended part 82. The anterior connecting part 85 extends toward the forward side +X from the front end 6*a* of the extended part 82 while inclining slightly to the other side −Y, and is continuous with the wall part side connecting part 83. The wall part side connecting part 83 has a columnar shape, and is provided on the lower surface thereof with a circular recessed part 83*a* into which the engaging part 69 provided on the second wall part 48 is insertable (see FIG. 4C). The plug member 7 is detachably connected to the second wall part 48 of the cartridge main body 21, by inserting the engaging part 69 into this circular recessed part 83*a*.

Ink Refilling Operation

Figure 5A:
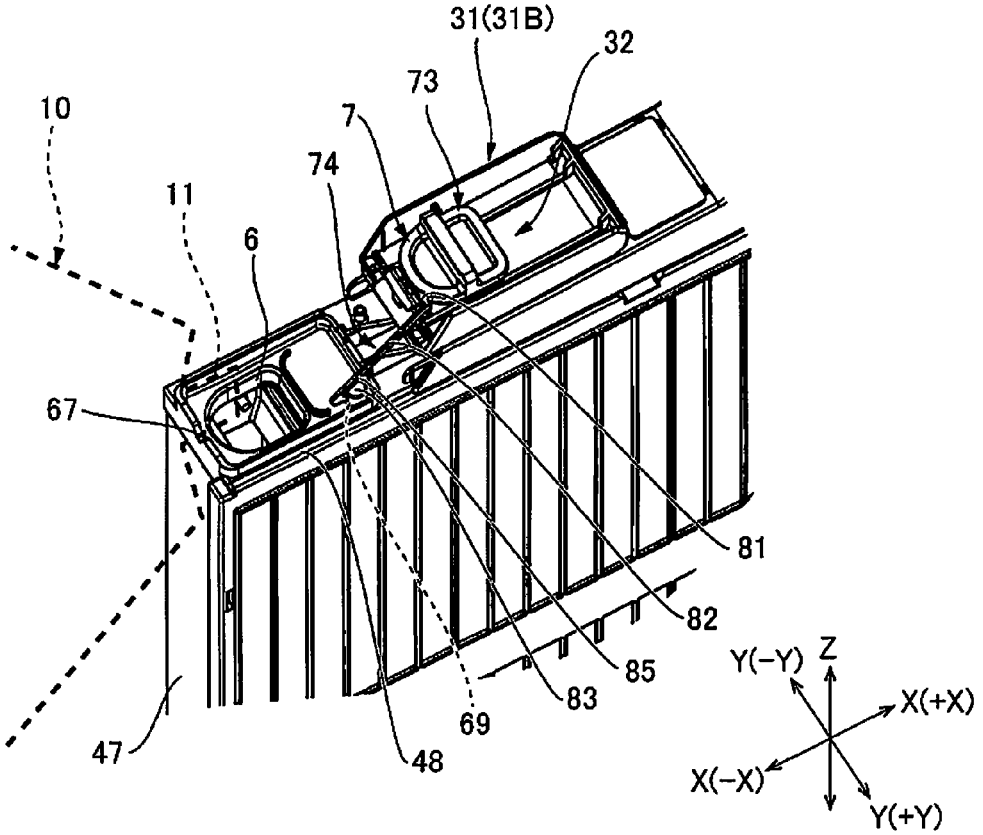
FIGS. 5A and 5B are diagrams illustrating an ink refilling operation in which ink is poured from an ink pack.
Figure 5B:
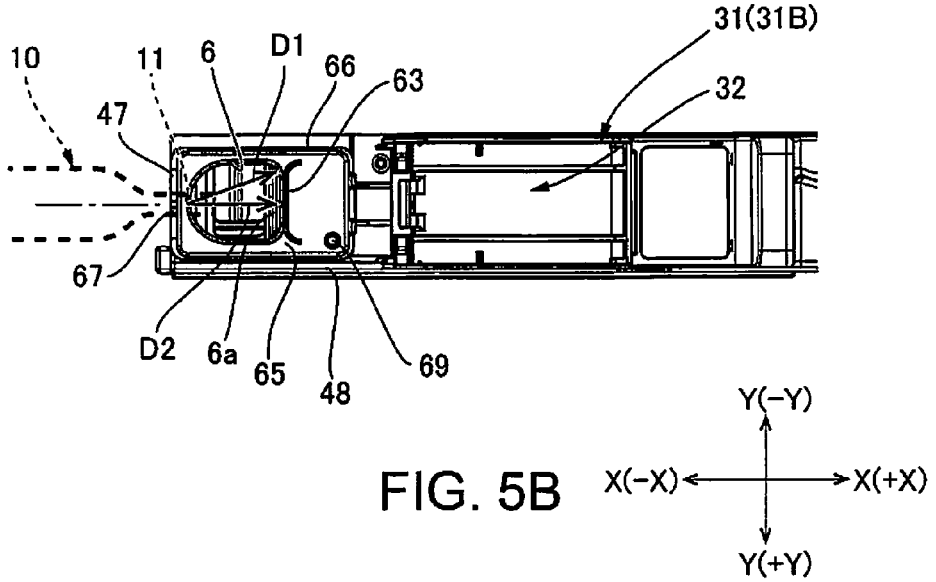

FIGS. 5A and 5B are illustrative diagrams of an ink refilling operation. FIG. 5A shows the case where the ink cartridge 1 is viewed from above the rearward side −X, and FIG. 5B shows the case where the ink cartridge 1 is viewed from above. FIG. 5B omits the plug member 7.

When refilling the ink cartridge 1 with ink, the opening/closing cover 31 is moved from the first position 31A to the second position 31B, and the plug member 7 and the ink inlet port 6 are exposed, as shown in FIG. 1A. Next, the plug member 7 is removed from the ink inlet port 6. Then, as shown in FIG. 5A, the plug member main body 73 is placed on the placing part 32 constituted by the opening/closing cover 31 disposed in the second position 31B.

Here, in the connecting member 74 connecting the plug member main body 73 of the plug member 7 to the second wall part 48 of the ink cartridge 1, the extended part 82 and the anterior connecting part 85 extend along the one side +Y of the plug member main body 73. Accordingly, when the plug member 7 is moved to the forward side +X and placed on the placing part 32, the line of movement of the plug member main body 73 does not coincide with the extended part 82 and the anterior connecting part 85. Even if ink is adhered to the plug member main body 73, the ink can thereby be prevented from adhering to the connecting member 74.

Also, the connecting member 74 is connected to a rear end portion of the plug member main body 73 by the plug member main body side connecting part 81, and a front end portion (wall part side connecting part 83) of the connecting member 74 is connected to the second wall part 48 via the engaging part 69. Accordingly, the length dimension of the connecting member 74 can be shortened relative to the movement distance that the plug member 7 is moved to the forward side +X. Furthermore, the plug member 7 is detachably connected to the second wall part 48 via the engaging part 69. Accordingly, the connecting member 74 separates from the engaging part 69 when a large force greater than or equal to a given force is applied to the connecting member 74, when the plug member 7 is pulled in a direction away from the ink inlet port 6 in order to open the ink inlet port 6. Therefore, the connecting member 74 can be prevented from being severed when the ink inlet port 6 is opened.

Next, ink is poured into the ink inlet port 6 from the refill ink pack 10. When pouring the ink, the ink pack 10 is positioned on the rearward side −X of the first wall part 47. The lower portion of the ink spout 11 of the ink pack 10 is then engaged in the groove 67 provided in the peripheral wall part 66. Thereafter, the ink pack 10 is tilted, and the ink is poured toward the forward side +X from the first wall part 47 side and into the ink inlet port 6.

Here, as shown in FIG. 5B, in this example, the ink inlet port 6 has a shape that is long in the front-rear direction X. Accordingly, when ink is poured toward the forward side +X from the first wall part 47 side, the ink is readily received by the ink inlet port 6. Also, the protruding part 68 extending in the width direction Y is provided at a position adjoining the front end 6*a* of the ink inlet port 6. Accordingly, in the case where the ink is poured vigorously and ink goes further on the forward side +X than the ink inlet port 6, the ink hits the protruding part 68 and flows back to the rearward side −X and into the ink inlet port 6. Accordingly, ink can be received by the ink inlet port 6.

Furthermore, in this example, the posterior opening portion of the ink inlet port 6 is provided with a shape that spreads out on both sides in the width direction Y toward the forward side +X from the rear end. Also, the opening area of the anterior opening portion of the ink inlet port 6 is larger than the opening area of the posterior opening portion. Furthermore, the front end 6*a* of the ink inlet port 6 has a linear shape extending in the width direction Y. Accordingly, ink can be received by the ink inlet port 6, even in the case where the direction of the ink that is poured from the ink pack 10 inclines relative to the front-rear direction X. That is, by providing the ink inlet port 6 with such a shape, in the case where the direction in which the ink is poured inclines relative to the front-rear direction X, a length dimension D1 of the ink inlet port 6 in the direction in which the ink is poured (direction inclining relative to the front-rear direction X) will be longer than a length dimension D2 of the ink inlet port 6 in the front-rear direction X (direction in the case where the direction in which ink is poured does not incline). Therefore, even when the ink is poured in a direction that inclines relative to the front-rear direction X, the ink can be received by the ink inlet port 6.

Also, in this example, the second wall part 48 is provided, around the ink inlet port 6, with the liquid receiving surface 65 that inclines downwardly toward the ink inlet port 6 side. Accordingly, in the case where ink that is poured spills from the ink inlet port 6 onto the liquid receiving surface 65, this ink is guided by the liquid receiving surface 65 and flows into the ink inlet port 6.

Furthermore, in this example, the peripheral wall part 66 surrounding the ink inlet port 6 is provided on the second wall part 48, and thus even if ink spills from the ink inlet port 6, the flow of ink can be dammed by the peripheral wall part 66. Accordingly, ink can be prevented from flowing onto the side surfaces of the ink cartridge 1. Furthermore, because the inner peripheral side of the peripheral wall part 66 serves as the liquid receiving surface 65 that is provided with a downward gradient facing the ink inlet port 6 side, ink dammed by the peripheral wall part 66 flows into the ink inlet port 6.

Thereafter, after the ink in the ink pack 10 has been filled into the ink cartridge 1, the ink inlet port 6 is blocked by the plug member 7. Here, because there is no ink adhering to the connecting member 74 of the plug member 7 when opening the ink inlet port 6 and moving the plug member 7 to the placing part 32, ink does not adhere to the user's hand or the like via the connecting member 74 when moving the plug member 7 from the placing part 32 to the ink inlet port 6.

Thereafter, the opening/closing cover 31 is moved from the second position 31B to the first position 31A, and the ink inlet port 6 and the plug member 7 are covered by the opening/closing cover 31. The ink refilling operation is thereby completed.

Modifications

Figure 6A:
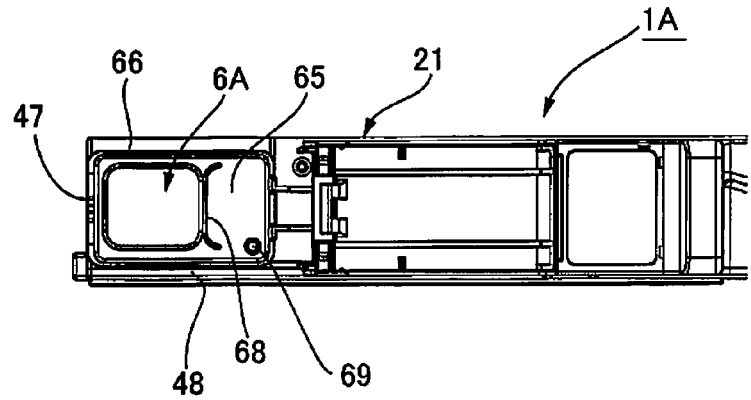
FIGS. 6A and 6B are diagrams illustrating ink cartridges of Modifications 1 and 2.
Figure 6B:
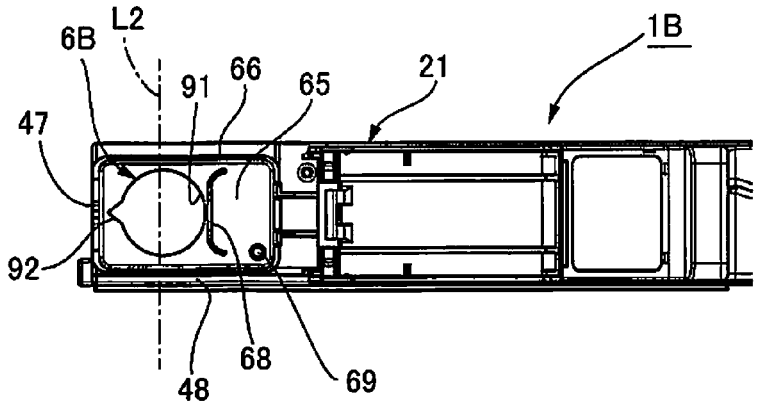

FIGS. 6A and 6B are illustrative diagrams of the ink cartridges of modifications in which the shape of the ink inlet port is differentiated from the above examples. Note that because the ink cartridges of the modifications are provided with a similar configuration to the ink cartridge 1, only configuration that differs will be described, and description of the remaining configuration is omitted.

The ink cartridge 1A of Modification 1 shown in FIG. 6A has an ink inlet port 6A having a rectangular shape whose long direction is in the front-rear direction X. The ink inlet port 6A is symmetrical right and left to the imaginary first center line L1 extending in the front-rear direction X. Also, the front end 6*a* of the ink inlet port 6 has a linear shape extending in the width direction Y. Ink that is poured to the forward side +X from the first wall part 47 side is also readily received by the ink inlet port 6 when this configuration is adopted.

In an ink cartridge 1B of Modification 2 shown in FIG. 6B, an ink inlet port 6B thereof is provided with a round hole portion 91 and a notched part 92 that is formed by cutting away a rear end portion of the round hole portion 91 on the rearward side −X to expand the opening. With the ink inlet port 6B in this example, the length dimension in the front-rear direction X is longer than the width dimension in the width direction Y by the amount of the notched part 92 extending on the rearward side −X. Also, the ink inlet port 6B is asymmetrical front and rear to the imaginary second center line L2 extending in the width direction Y through the center of the ink inlet port 6B in the front-rear direction X, and has an anterior opening portion on the front side of the second center line L2 whose opening area is larger than the opening area of the posterior opening portion. In this example, the ink pack 10 from which ink is poured can be prevented from moving in the width direction Y by abutting the mouth of the ink pack 10 against the notched part 92 from below.

Figure 7A:
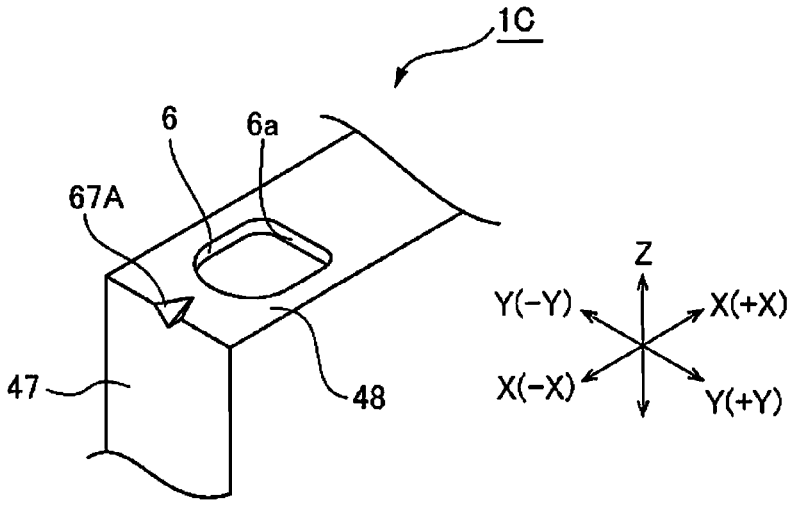
FIGS. 7A and 7B are diagrams illustrating ink cartridges of Modifications 3 and 4.
Figure 7B:
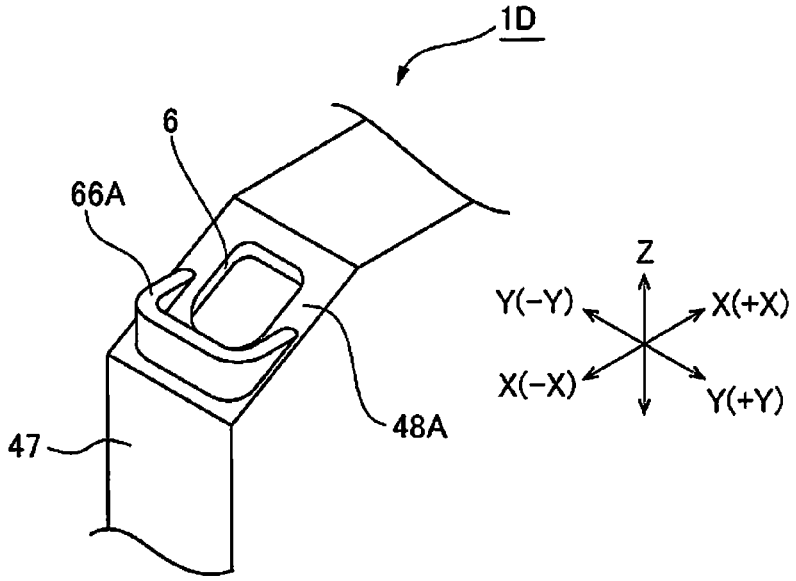

FIGS. 7A and 7B are illustrative diagrams of the ink cartridges of modifications in which the peripheral configuration of the ink inlet port 6 is differentiated from the above examples. In an ink cartridge 1C of Modification 3 shown in FIG. 7A, the peripheral wall part 66 is not provided on the second wall part 48. The second wall part 48 is provided with the ink inlet port 6 in a flat surface thereof. Also, the surface of the second wall part 48 is provided with a groove 67A at a position closer to the rear end of the ink inlet port 6 than to the front end 6*a* of the ink inlet port 6. More specifically, a V-shaped groove 67A cut away from above and from the rearward side −X is formed in the rear edge of the upper surface of the second wall part 48. In this example, the ink pack 10 from which the ink is poured can be prevented from moving in the width direction Y by engaging the ink pack 10 in the groove 67A. Note that, in this example, the liquid receiving surface 65 and the protruding part 68 can be provided.

In an ink cartridge 1D of Modification 4 shown in FIG. 7B, the second wall part 48A in which the ink inlet port 6 is formed inclines upwardly toward the forward side +X from an upper edge of the first wall part 47. A peripheral wall part 66A partially surrounding the ink inlet port 6 on the rearward side −X is provided on the second wall part 48A. This example also enables the flow of ink to be dammed by the peripheral wall part 66A, in the case where ink spills from the ink inlet port 6. Note that, in this example, the liquid receiving surface 65 and the protruding part 68 can be provided. Also, the groove 67 can be provided in the peripheral wall part 66A.

What is claimed is:

1. A liquid container comprising a first wall and a second wall extending in a first direction that intersects the first wall, wherein the second wall has an opening part configured to receive a liquid that is poured therein from a side of the first wall, the opening part includes a through hole through which inner space of the liquid container communicates with outer space, the through hole has a length dimension in the first direction that is longer than a width dimension in a second direction that intersects the first direction, a peripheral wall part at least partially surrounding the opening part is provided on the second wall, and a protruding part extending in the second direction is provided on the second wall between the through hole and the peripheral wall part, the protruding part being separated from the peripheral wall part.

2. The liquid container according to claim 1, wherein the peripheral wall part has a groove located closer to a rear end of the opening part in the first direction than to a front end of the opening part in the first direction.

3. The liquid container according to claim 1, wherein a groove located closer to a rear end of the opening part in the first direction than to a front end of the opening part in the first direction is formed in a surface of the second wall.

4. The liquid container according to claim 1, wherein the second direction is orthogonal to the first direction, and a front end of the opening part in the first direction is formed to have a linear shape extending in the second direction.

5. The liquid container according to claim 4, wherein a rear end of the opening part in the first direction has a shape that spreads out on both sides in the second direction toward the front end from the rear end.

6. The liquid container according to claim 4, wherein the protruding part extending in the second direction is provided on the second wall at a position adjoining the opening part on a forward side in the first direction.

7. The liquid container according to claim 1, wherein the second wall includes, on a periphery of the opening part, a liquid receiving part configured to receive liquid that spills from the opening part.

8. The liquid container according to claim 1, comprising:

a plug member that removably blocks the opening part, wherein the plug member includes:

a plug member main body capable of blocking the opening part; and a connecting member for connecting the plug member main body to the second wall, the connecting member includes:

a plug member main body side connecting part connected to a posterior portion of the plug member main body in the first direction;

an extended part extending in the first direction along a lateral side of the plug member main body in the second direction; and a wall side connecting part configured to be connected to the second wall, and the wall side connecting part is located on a forward side of the extended part in the first direction.

9. The liquid container according to claim 8, wherein an engaging part for connecting the plug member is provided on the second wall, and the wall side connecting part is configured to be detachably connected to the engaging part.

10. The liquid container according to claim 1, wherein the liquid is ink.

11. The liquid container according to claim 1, wherein the protruding part is provided so as to extend longer in the second direction than a front end of the opening part.

12. A liquid container comprising a first wall and a second wall extending in a first direction that intersects the first wall, wherein the second wall has an opening part configured to receive a liquid that is poured therein from a side of the first wall, the opening part includes a through hole through which inner space of the liquid container communicates with outer space, the through hole has a length dimension in the first direction that is longer than a width dimension in a second direction that intersects the first direction, and a protruding part is provided on the second wall at a position adjoining the through hole on a forward side in the first direction, the protruding part including a middle portion extending along a front end of the through hole in the second direction, and a pair of outer portions inclining outwardly toward the forward side from the middle portion on both sides of the middle portion in the second direction.

13. A liquid container comprising a first wall and a second wall extending in a first direction that intersects the first wall, wherein the second wall has an opening part configured to receive a liquid that is poured therein from outside, the opening part includes a through hole through which inner space of the liquid container communicates with outer space, the through hole has a length dimension in the first direction that is longer than a width dimension in a second direction that intersects the first direction, a protruding part extending in the second direction is provided on the second wall, and the protruding part is provided so as to extend longer in the second direction than a front end of the opening part, the liquid container further comprising a plug member that removably blocks the opening part.

14. The liquid container according to claim 13, wherein a peripheral wall part at least partially surrounding the opening part is provided on the second wall, and the peripheral wall part has a groove located closer to a rear end of the opening part in the first direction than to a front end of the opening part in the first direction.

15. The liquid container according to claim 13, wherein a groove located closer to a rear end of the opening part in the first direction than to a front end of the opening part in the first direction is formed in a surface of the second wall.

16. The liquid container according to claim 13, wherein the second direction is orthogonal to the first direction, and a front end of the opening part in the first direction is formed to have a linear shape extending in the second direction.

17. The liquid container according to claim 16, wherein a rear end of the opening part in the first direction has a shape that spreads out on both sides in the second direction toward the front end from the rear end.

18. The liquid container according to claim 16, wherein a protruding part extending in the second direction is provided on the second wall at a position adjoining the opening part on a forward side in the first direction.

19. The liquid container according to claim 13, wherein the second wall includes, on a periphery of the opening part, a liquid receiving part configured to receive liquid that spills from the opening part.

20. The liquid container according to claim 13 wherein the plug member includes:

a plug member main body capable of blocking the opening part; and a connecting member for connecting the plug member main body to the second wall, the connecting member includes:

a plug member main body side connecting part connected to a posterior portion of the plug member main body in the first direction;

an extended part extending in the first direction along a lateral side of the plug member main body in the second direction; and a wall side connecting part configured to be connected to the second wall, and the wall side connecting part is located on a forward side of the extended part in the first direction.

21. The liquid container according to claim 20, wherein an engaging part for connecting the plug member is provided on the second wall, and the wall side connecting part is configured to be detachably connected to the engaging part.

22. The liquid container according to claim 13, wherein the liquid is ink.

23. The liquid container according to claim 13, wherein a protruding part is provided on the second wall at a position adjoining the through hole on a forward side in the first direction, the protruding part including a middle portion extending along a front end of the through hole in the second direction, and a pair of outer portions inclining outwardly toward the forward side from the middle portion on both sides of the middle portion in the second direction.

24. The liquid container according to claim 13, wherein a peripheral wall part at least partially surrounding the opening part is provided on the second wall, and a protruding part extending in the second direction is provided on the second wall between the through hole and the peripheral wall part.

* * * * *